US005099283A

United States Patent [19]

Maruyama

[11] Patent Number: 5,099,283

[45] Date of Patent: Mar. 24, 1992

[54] ELECTROPHOTOGRAPHIC APPARATUS WITH LEADING EDGE BLANKING

[75] Inventor: Hiroyoshi Maruyama, Yokohama, Japan

[73] Assignee: Canon Kabushiki Kaisha, Tokyo, Japan

[21] Appl. No.: 274,978

[22] Filed: Nov. 22, 1988

[30] Foreign Application Priority Data

Nov. 28, 1987 [JP] Japan ..... 62-301122

[51] Int. Cl.[5] ..... G03G 21/00; G03G 15/02

[52] U.S. Cl. ..... 355/218; 355/219; 355/225; 355/315

[58] Field of Search ..... 355/218, 219, 221, 225, 355/315

[56] References Cited

U.S. PATENT DOCUMENTS

| | | | |
|---|---|---|---|
| 4,375,331 | 3/1983 | Tohyama et al. | 355/218 X |
| 4,551,005 | 11/1985 | Koichi | 355/218 X |
| 4,603,964 | 8/1986 | Swistak | 355/225 |
| 4,743,947 | 5/1988 | Yamamoto | 355/218 |
| 4,839,695 | 6/1989 | Yamamoto et al. | 355/218 |
| 4,847,657 | 7/1989 | Hanada et al. | 355/218 |

FOREIGN PATENT DOCUMENTS

| | | | |
|---|---|---|---|
| 57-8554 | 1/1982 | Japan . | |
| 61-183672 | 8/1986 | Japan . | |
| 62-215565 | 9/1986 | Japan | 355/225 |

*Primary Examiner*—Fred L. Braun

*Attorney, Agent, or Firm*—Fitzpatrick, Cella, Harper & Scinto

[57] ABSTRACT

An electrophotographic apparatus wherein a blank is formed at an end of a transfer material to make it easier to separate the transfer material from a photosensitive member and to prevent the transfer material from wrapping around an image fixing roller. A light reflecting portion is formed at a position corresponding to a leading edge of an original on an original supporting platen. The light reflecting portion receives light from an original illuminating lamp and reflects it to the region of the photosensitive member that has been opposed to a charger when the charge is switched from its non-operative state to an operative state.

29 Claims, 7 Drawing Sheets

ELECTROPHOTOGRAPHIC APPARATUS WITH LEADING EDGE BLANKING

FIELD OF THE INVENTION AND RELATED ART

The present invention relates to an electrophotographic apparatus such as an electrophotographic copying machine, for a more particularly to an electrophotographic apparatus wherein white image or blank (non-image) area is formed at a leading end portion of an image.

In an electrophotographic apparatus, if developing toner is deposited at a leading end of a transfer material, a transfer material conveying means is contaminated when the leading edge is brought into abutment with the conveying means. Or, when the leading end is introduced into a nip of image fixing rollers, the toner is deposited onto one of the fixing rollers with the result that the transfer material is not satisfactorily separated from the roller so that the transfer material is jammed. Particularly when the image fixing device is of the type wherein the transfer material is conveyed in the nip formed between hot rollers, the toner at the leading end of the transfer material is softened or fused to become adhesive when it is contacted to the hot roller, so that the transfer material and the heating roller are bonded, with the result that the separation becomes difficult, particularly when the transfer material is thin.

In order to avoid these problems, it is conventional that, even if the image is present to its end corresponding to the leading end of the transfer material, a uniform light exposure (blank exposure) is effected to an area on the photosensitive member corresponding to a small area (0.5–2.0 mm, approximately) at the leading end of the transfer material, thus forming a blank (non-image area). The photosensitive member is exposed to the image light reflected by the original within the area except the blank exposure area. As for the method of the blank exposure, it is known to provide an original supporting platen with white reflection member at its bottom surface corresponding to the leading edge of the original (Japanese Patent Application Publication No. 36502/1979).

As shown in FIGS. 4 and 5, another method is disclosed in Japanese Laid-Open Patent Application 183672/1986 wherein a white reflection portion is formed on a top surface of the original supporting platen glass, and in addition, the light from another light source is projected to the portion corresponding to the white reflecting portion. In this system, in order to remove the electric charge outside the latent image forming area of the photosensitive member, a blank exposure lamp is used. However, the use of the blank exposure lamp results in bulkiness of the apparatus with increase of the cost.

Another method is shown in FIG. 4 wherein the light from another light source is additionally projected onto the portion of the photosensitive member corresponding to the white reflecting portion. In this system, as shown in FIG. 5, the additional light source is constituted by plural fuse lamps with the result of non-uniform light distribution along the circumferential and longitudinal directions of the photosensitive member 101, and therefore, the light can be projected outside the white reflecting portion. This deteriorates the quality of the produced image because the boundary between the image portion and the blank is not sharp.

As another method, Japanese Laid-Open Patent Application 8554/1982 discloses a copying machine wherein a blank is formed by controlling electric charge on the photosensitive member. However, as shown in and as will be understood from FIG. 6, the dimension of the blank formed thereby on the copying sheet (transfer material) is different depending on the difference in the image density at the leading end portion of the original, or the non-uniformness results from an inclination of the rise of the voltage (potential), thus deteriorating the quality of the copy image.

SUMMARY OF THE INVENTION

Accordingly, it is a principal object of the present invention to provide an electrophotographic apparatus wherein a stabilized blank is formed at the leading end portion of the image by selectively actuating a charging means, so that a good image can be provided.

It is another object of the present invention to provide an image forming apparatus wherein the leading end blank is formed by application of light and also by selective actuation of the charging means to provide a sharply divided image forming area and a nonimage area.

It is a further object of the present invention to provide an image forming apparatus wherein a transfer apparatus is separated in good order from an image fixing means by the formation of the blank at the leading end of the transfer material.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
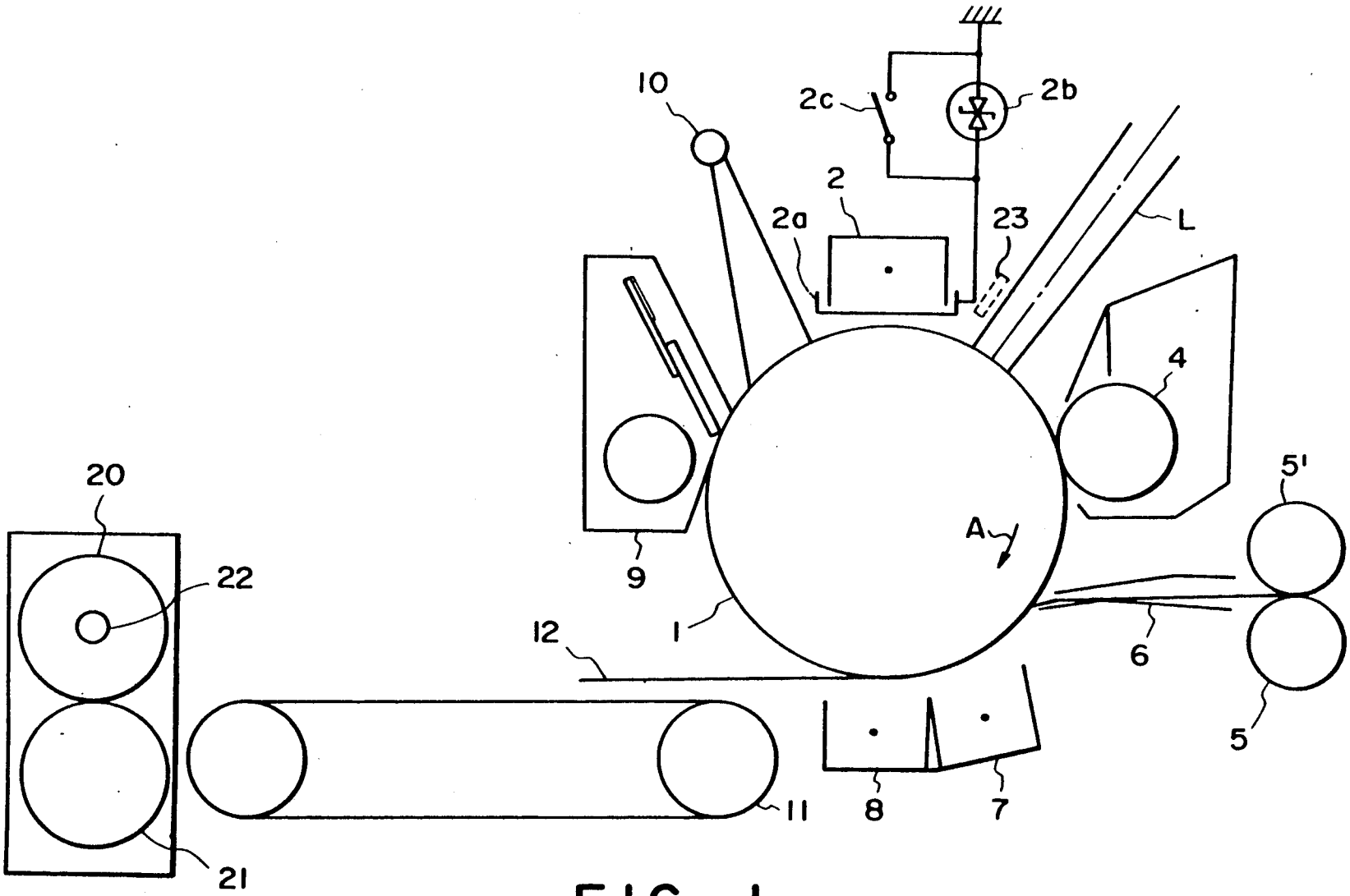
FIG. 1 is a somewhat schematic sectional view of an electrophotographic apparatus according to an embodiment of the present invention.
Figure 2:
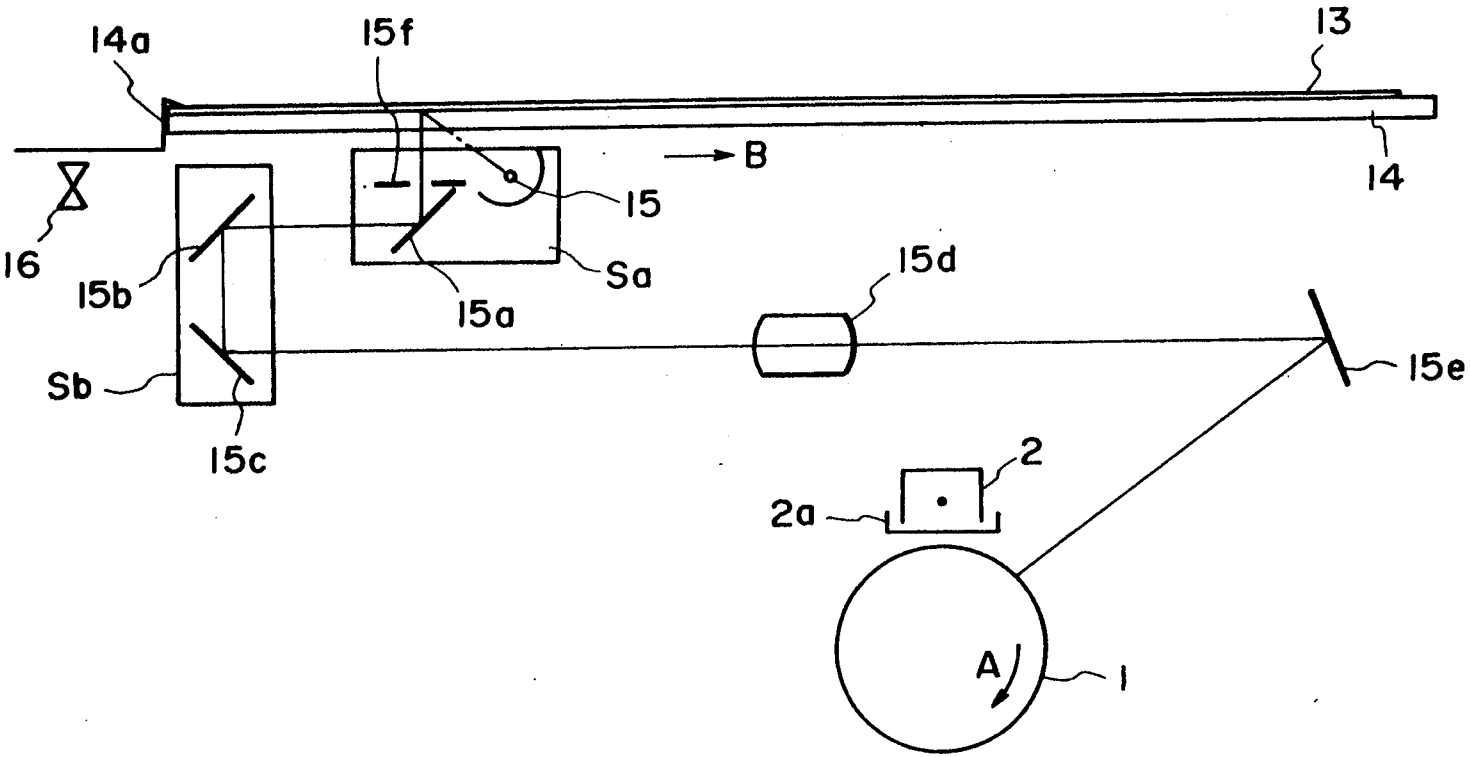
FIG. 2 is a sectional view of an optical system of the apparatus of FIG. 1.

Referring now to FIGS. 1 and 2, there is shown an electrophotographic apparatus according to an embodiment of the present invention. The electrophotographic apparatus comprises a photosensitive member 1, charging means in the form of a corona charger having a wire electrode and a shield electrode for uniformly charging the surface of the photosensitive member 1 and a developing device having a developing sleeve 4 for developing with toner an electrostatic latent image formed on the photosensitive member 1 by light L reflected by an original to be copied. The apparatus further includes a conveying roller for conveying a sheet 12 onto which the developed image is to be transferred from the photosensitive member 1, a guide 6 for guiding the sheet 12, a transfer corona charger 7 for transferring the toner image onto the sheet 12, a separation corona discharger 8 for separating the sheet 12 from the photosensitive member 1, a cleaner 9 for cleaning the toner remaining on the photosensitive member 1, a discharge lamp 10 for dissipating the potential remaining on the photosensitive member 1, a conveying belt 11 for conveying the sheet 12 having received the image transferred thereonto, and an image fixing device having a pair of fixing rollers 20 and 21 for fixing the toner image on the sheet conveyed by the conveying belt 11. In this embodiment, the photosensitive material of the photosensitive member 1 is OPC (organic photoconductor), but may be another photosensitive material such as amorphous silicon, selenium or the like.

The corona charger 2 has a grid 2*a* functioning as a control electrode controlling the charge of the photosensitive member 1. The grid 2*a* is electrically grounded through a varistor 2*b* and a relay 2*c*.

FIG. 2 shows a scanning optical system of the apparatus shown in FIG. 1. An original 13 is placed on an original supporting platen glass 14 which is provided with a white reflecting layer 14*a* functioning as a light reflecting portion, printed on a top surface thereof at a portion corresponding to the leading end of the original 13. The white reflecting layer 14*a* extends along a leading edge of an original, as will be understood from FIG. 3, too. The original 13 is illuminated by an illumination lamp 15, and an image thereof is projected onto the photosensitive member 1 through mirrors 15*a*, 15*b* and 15*c*, a lens 15*d*, a mirror 15*e* and a slit 15*f*. The illumination lamp 15 moves in a direction indicated by an arrow B which is perpendicular to a longitudinal direction of the white reflecting layer 14*a*, during which the image of the original 13 is projected onto the photosensitive member 1. Scanner constituted by scanner elements Sa and Sb is detected by a sensor 16 at the starting position.

Figure 11:
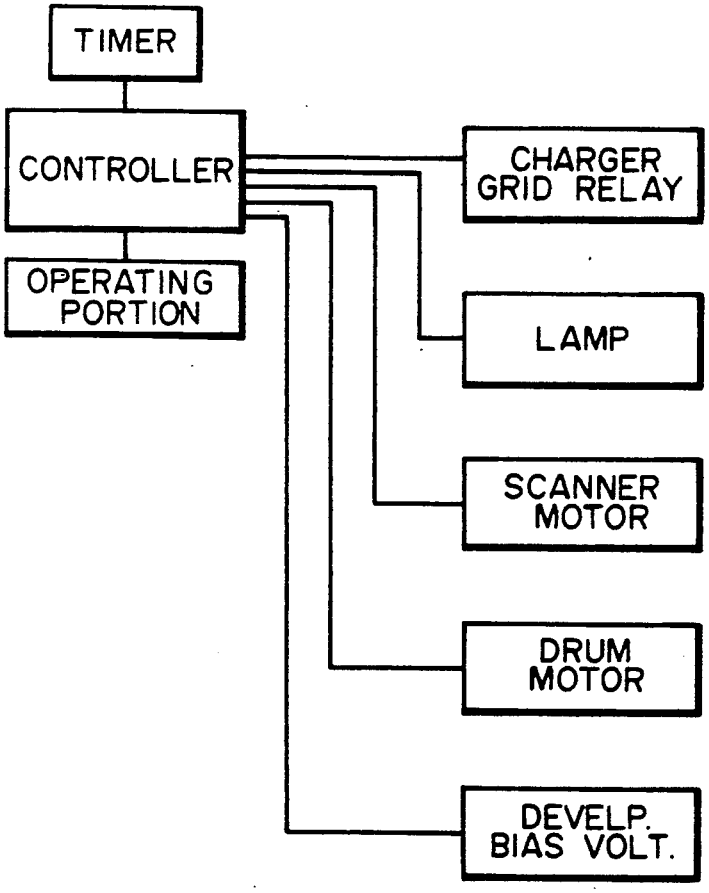
FIG. 11 is a block diagram illustrating control system of an electrophotographic apparatus according to an embodiment of the present invention.

As shown in FIG. 11, a relay 2*c* for the grid 2*a* of the corona charger, an original illuminating lamp 15, a motor for moving the scanner elements Sa and Sb, a motor for rotating the photosensitive member and the developing bias voltage, are on-off-controlled by a controller, using a timer connected to the controller and in response to an actuation of a control panel by an operator, which is electrically connected to the controller.

In operation, the photosensitive member 1 rotates in a direction indicated by an arrow A. During the rotation, the photosensitive member 1 is uniformly charged at its surface to a negative polarity by a corona charger 2. At this time the grid 2*a* is grounded through the varistor 2*b*. By application of the light L reflected by the original to the photosensitive member 1, an electrostatic latent image is formed, which is then developed into a visualized toner image with positively charged toner on the developing sleeve 4 of the developing device, wherein the toner is deposited onto such an area of the photosensitive member surface as has not been illuminated by the light, and therefore, has a high potential. On the other hand, the sheet 12 conveyed by the pair of conveying rollers 5 and 5' along the transfer sheet guide 6, is fed to an image transfer station in a timed relation with the leading edge of the image on the photosensitive member 1. In the image transfer process in the transfer station, the toner image is transferred onto the thus fed sheet 12 from the photosensitive member 1 to the sheet 12 by a transfer corona charger 7. The sheet 12 is then separated from the photosensitive member 1 by application of separation corona discharge by a separating corona discharger 8. The sheet 12 is subsequently conveyed by the conveying belt 11 and is passed through a nip formed between a heating roller 20 having a heater 22 and a back-up roller 21 of the fixing device, by which the toner image on the sheet 12 is fused and fixed by heat thereon.

On the other hand, the toner remaining on the photosensitive member 1 after the image transfer step is removed by the cleaner 9. Further, the electric charge remaining on the surface of the photosensitive member 1 is erased by the discharging lamp 10, so that the photosensitive member 1 is prepared for the next cycle. The original illuminating system scanningly moves in the direction indicated by an arrow B from its start position across the scanner Sa and the sensor 16.

Figure 7:
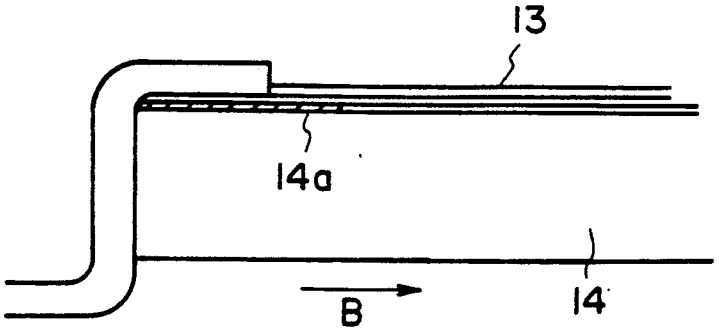
FIG. 7 shows a portion of an original carriage corresponding to the leading end portion of an original in an apparatus according to an embodiment of the present invention.

The blank exposure formation in this embodiment will be described. Referring to FIG. 7, which is an enlarged view of the leading portion of the original, the original 13 is placed on the platen glass 14 with its leading portion overlaid on the white reflecting layer 14*a* in the form of a strip. When the light source 15 of the scanning element Sa illuminates the white reflecting layer 14*a*, the boundary area between the original platen glass 14 and the white reflecting layer 14*a*, which is a mirror surface, reflects the light with high directivity, so that the amount of light through the slit 15*f* decreases, and therefore, the photosensitive member 1 is not exposed to a sufficient amount of light to provide white area, but the exposure is uniform in accordance with the light reflected. When the original 13 illuminated by the light source 15 is a sheet of paper or the like, the light reflected thereby is scattered since the surface of the paper is relatively rough as compared with the boundary mirror surface between the original platen glass 14 and the white reflecting layer 14*a*. Therefore, the amount of light through the slit 15*f* is larger than that of the light reflected by the white reflecting layer 14*a*, and therefore, the photosensitive member 1 is exposed to a sufficient amount of light.

Using FIGS. 8 and 9, the operational sequence will be described. In FIG. 9, a region a-b on the photosensitive member 1 is the region which is faced to the grid 2*a* of the corona charger 2, and therefore, which can be charged thereby. In this embodiment, the grid 2*a* is an etched grid. The width of the grid 2*a* measured along the direction of movement of the photosensitive member 1 is 12 mm in this embodiment. The region a-b on the photosensitive member 1 substantially corresponds to the width of the opening of the grid 2*a*. More particularly, the point a is located below an upstream end of the grid opening with respect to movement of the photosensitive member, and the point b is located below the downstream end thereof. The reference c designates an exposure position on the photosensitive member 1. In this embodiment, the process speed of the photosensitive member 1 is 100 mm sec, and the diameter of the photosensitive drum 1 is 32 mm.

Figure 8:
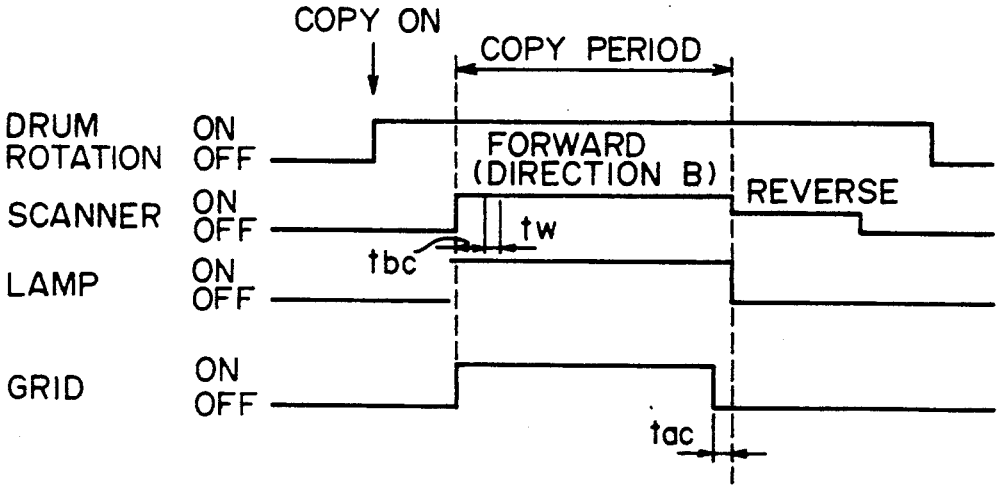
FIG. 8 shows sequential operation of an apparatus according to an embodiment of the present invention.
Figure 9:
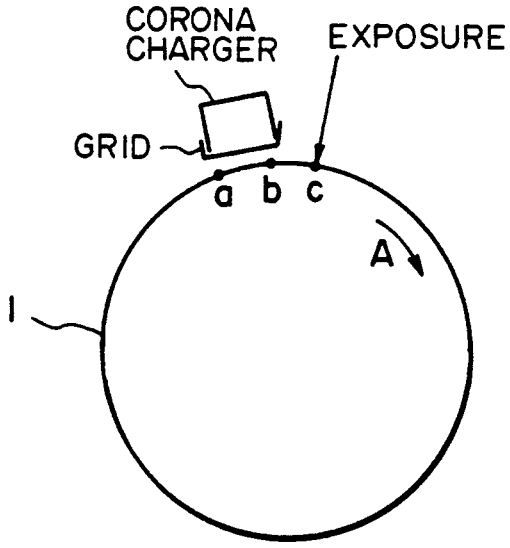
FIG. 9 illustrates a charging and exposure positions on the photosensitive member.

Referring to FIG. 8, when the operator depresses an unshown copy button on an operation panel, the controller actuates the motor for the photosensitive drum 1 so as to start rotation of the photosensitive member 1. On the other hand, the corona charger 2 is supplied with a voltage from a high voltage source prior to image forming operation. However, the charging action by the corona charger 2 starts at a position of the photosensitive member 1 corresponding to the leading edge of the original which is determined on the basis of a detection signal provided by the sensor 16 of the scanner. More particularly, the relay 2c is closed so that the grid 2a is grounded (off), by which the corona current produced by the corona charger 2 is flown to the ground, and therefore, the surface of the photosensitive member 1 is not charged. When the position of the photosensitive member 1 corresponding to the leading edge of the original reaches the position b (this is determined on the basis of a count of the timer), the controller opens the relay 2c, by which the grid 2a is grounded but only through the varistor 2b (grid is on). By this, the charging action starts at the position b. The grid 2a is supplied with a voltage determined by the varistor 2b voltage, which is preferably about 1000 V. Thus, the current flows to the photosensitive member 1, so that the photosensitive member 1 is uniformly charged.

As shown in FIG. 8, the controller actuates the motor for the scanner elements Sa and Sb simultaneously with actuation of the grid 2a, whereupon the scanner starts to advance in the direction B in FIG. 2. The controller lights the original illumination lamp 15 prior to the start of the movement of the scanners Sa and Sb in consideration of the starting transient period of the lamp 15. A time period $t_{bc}$ required for the position b on the photosensitive member 1 at which the charging starts by the opening of the relay 2c of the grid 2a to reach the exposure position c, is a pre-run period for stabilizing movement of the scanner elements Sa and Sb. After the time period $t_{bc}$ from the start of movement of the scanners Sa and Sb, the scanners Sa and Sb reach the positions at which the original illuminating lamp 15 projects the light to the original at the leading position. The lamp 15 illuminates the white reflecting layer 14a at the position corresponding to the leading edge of the original, and the light reflected thereby is projected onto the photosensitive member 1 at a position where the charging action started. A time period $t_w$ is a movement period of the scanners Sa and Sb between the time when the illumination lamp illuminates a position of the white reflecting layer 14a corresponding to the leading edge of the original and the time when it illuminates the position where the actual original appears. During the time period $t_w$, the photosensitive member 1 is exposed to the light corresponding to the white reflecting layer 14a at the original leading edge portion.

Figure 3:
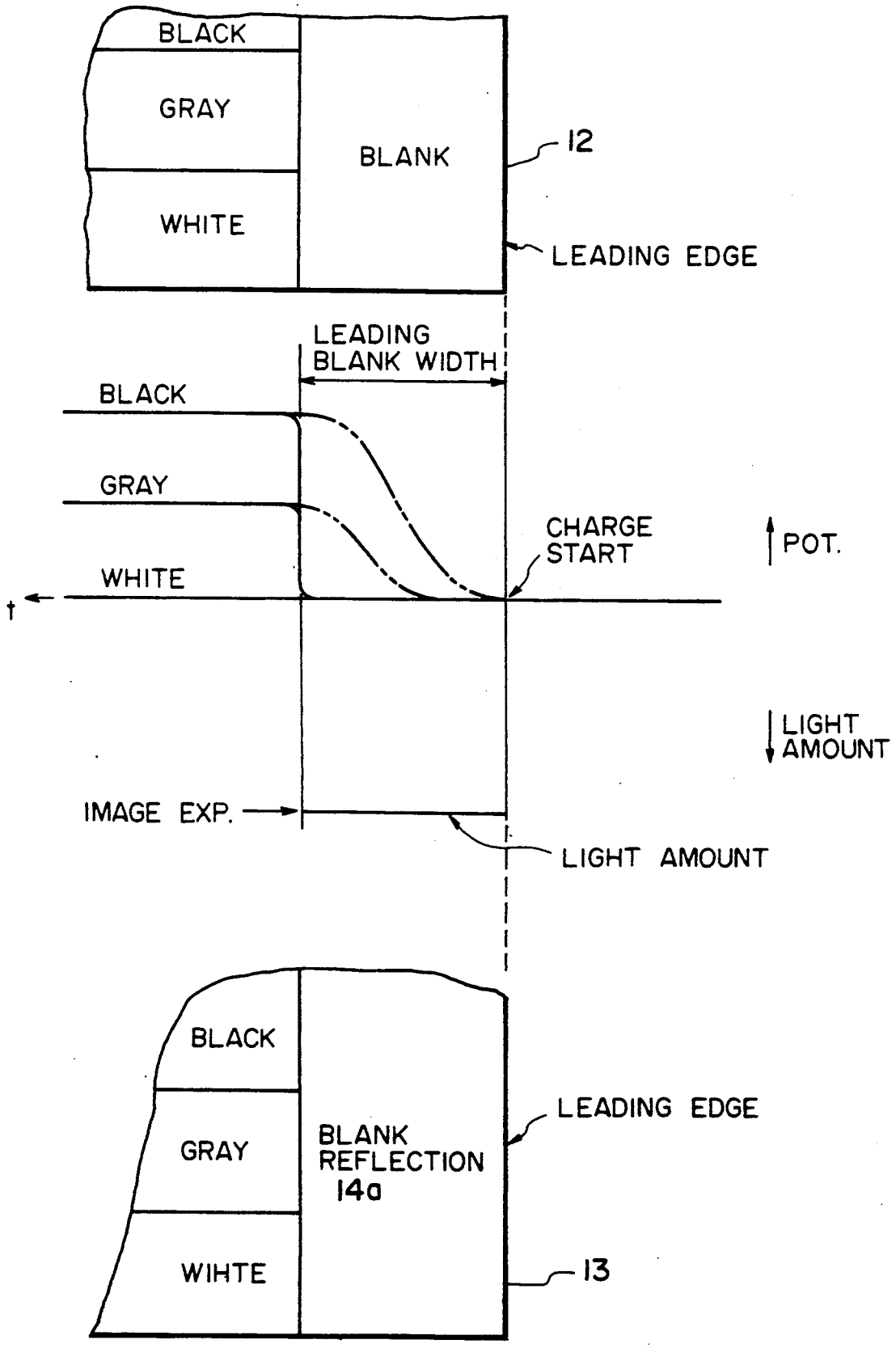
FIG. 3 illustrates formation of a leading blank.
Figure 4:
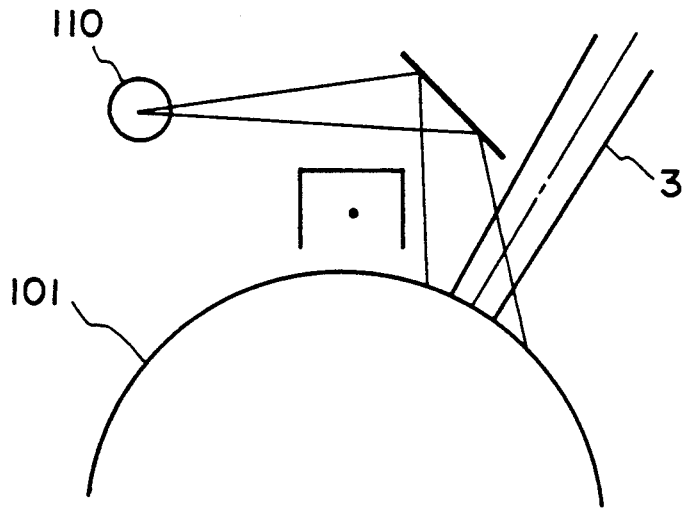
FIGS. 4 and 5 illustrate conventional electrophotographic apparatus.
Figure 5:
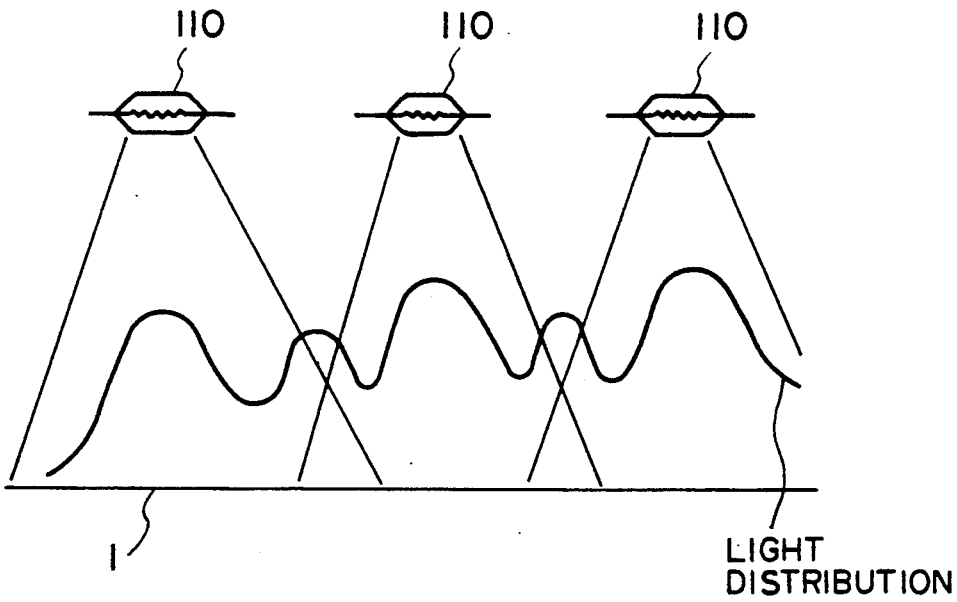
Figure 6:
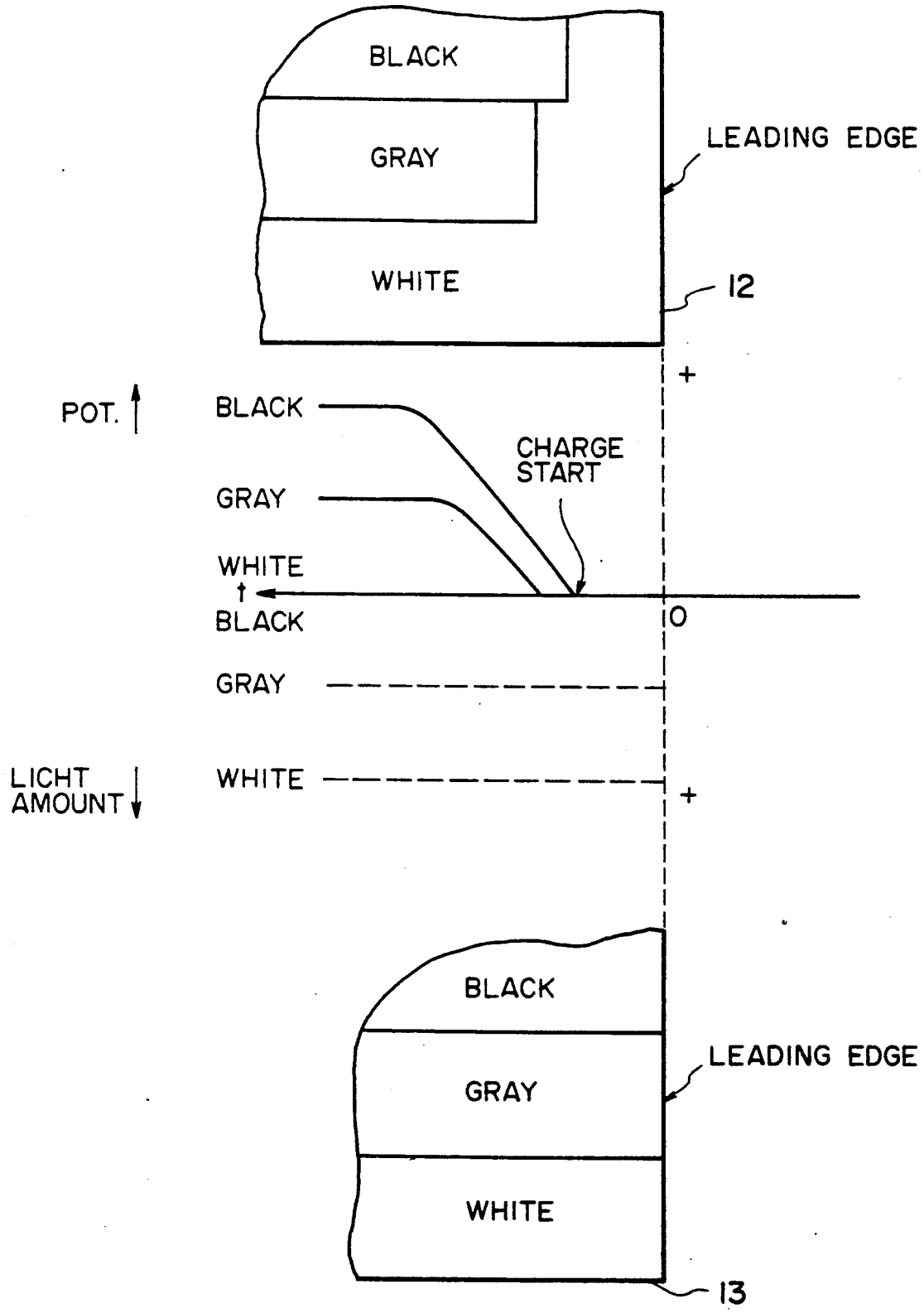
FIG. 6 illustrates formation of a leading blank in a conventional apparatus.

Referring back to the charging action by the corona charger 2, when the charging action starts, the photosensitive member is electrically charged in the portion faced to the corona charger 2, in other words, the region corresponding to the opening of the grid 2a, and the charging is uniform in the longitudinal direction thereof, that is, the direction perpendicular to the sheet of drawing of FIGS. 1 and 2. However, as shown in FIG. 3, since the charger has a certain width, and since the amount of charge is no so quickly increased, the charge on the photosensitive member increases with certain inclination along the circumferential direction of the photosensitive member surface. The inclined portion of the photosensitive member is exposed to a predetermined amount of light provided by the white reflecting layer 14a, by which the potential of the photosensitive member is uniformly decreased so that a uniform lead blank is formed (FIG. 3). As shown in the blank portion in the leading portion of the transfer sheet in FIG. 3, the charging is uniform in the circumferential and longitudinal directions of the photosensitive member 1, a sharply defined blank can be formed, corresponding to the white reflecting surface 14a on the original platen glass 14.

Referring to FIG. 8, when the scanners Sa and Sb switch from the forward movement to the backward movement, the trailing edge (in the scanning direction) of the original is illuminated. The grid 2a is grounded a certain period ($t_{ac}$) prior to the switching of the charger to stop charging action on the photosensitive member 1. This is done in order to charge the photosensitive member within the region corresponding to the original, in other words, corresponding to the size of the transfer material. The time period $t_{ac}$ is a period required for the point a to reach the point c. The region corresponding to the original means a latent image formation region which corresponds to the size of the original. Therefore, when it is overlaped with the light reflecting layer, the overlaped portion is contained in the latent image formation region.

As described, in this embodiment, the relay 2c of the grid 2a is controlled by the controller so that the latent image formation region of the photosensitive member 1, that is, the region corresponding to the size of the transfer sheet thereof, is electrically charged, whereas the region outside thereof is not charged, and therefore, the necessity is eliminated for employing exposure means for removing electric charge, which is necessitated when unnecessary charge outside the above region of the photosensitive member is charged.

In the foregoing description, when the grid 2a is rendered "on", the region of the photosensitive member faced to the opening of the grid 2a is exposed to the light reflected by the white reflecting layer 14a for the leading edge of the original. If, as shown in FIG. 7, the white reflecting layer 14a is provided at further front portion of the original (upstream side in the scanning direction), the timing of rendering the grid 2a "on" can be made earlier by the amount corresponding to the additional white reflection area. By the further provision of the white reflecting layer 14a extending further from the leading edge of the original, the latitude of the determination of the sequential timing is increased.

The timing of rendering the grid "on" can be delayed from the position of the photosensitive member corresponding to the leading edge of the original, as shown in FIG. 3, if it is within the area corresponding to the blank reflection portion, and therefore, it is preferable that the timing is adjustable.

Figure 10:
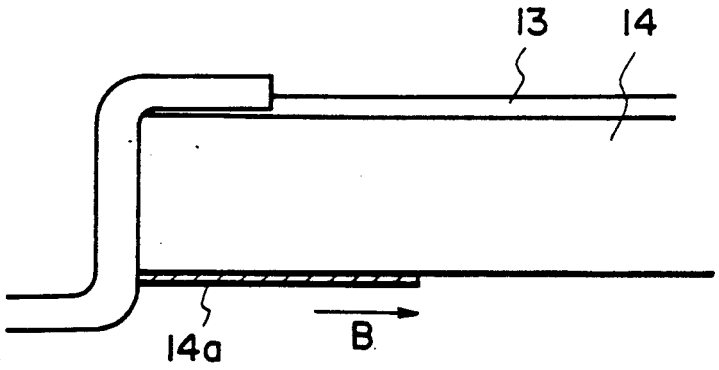
FIG. 10 shows a portion of an original carriage corresponding to a leading edge of an original according to another embodiment of the present invention.

In the foregoing, as shown in FIG. 7, the white reflecting layer 14a is provided on the top of the original supporting glass 14, but it may be provided on the bottom surface of the original supporting glass 14 as shown in FIG. 10. More particularly, a sheet of white paper may be mounted as the white reflecting layer 14a to the bottom surface of the original platen glass 14. This is advantageous over the FIG. 7 structure, in that when it is illuminated by the illumination lamp 15, a sufficient amount of light is directed to the slit 15f, and therefore, the amount of light on the photosensitive member is sufficient. However, it involves a disadvantage that the boundary between the original and the white reflecting layer 14*a* is blurred on the photosensitive member 1 because the optical path length between the illumination lamp 15 and the white reflecting layer 14*a* is different from the optical path length between the original illumination lamp 15 and the original. Therefore, even where the white reflecting layer 15*a* is formed on the bottom surface of the original supporting platen glass 14 as shown in FIG. 10, it is preferable that when the charging means is actuated to start its charging operation, the region of the photosensitive member which corresponds to the charging means is exposed to the light reflected by the white reflecting layer 14*a* to positively form the lead blank.

In the foregoing embodiment, the white reflecting layer 14*a* is formed on the original supporting glass 14, but it is a possible alternative to provide the white reflecting member 14*a* optically between the original 13 and the original illuminating light 15, for example.

In addition, the lead blank can be more sharply formed by controlling the developing device. More particularly, a bias voltage to the developing sleeve 4 is controlled such that the toner is not transferred from the sleeve 4 to the photosensitive member when the region of the photosensitive member which corresponds to the lead blank is opposed to the sleeve 4 of the developing device, but the bias voltage is controlled such that the toner is transferred onto the photosensitive member from the sleeve 4 when the latent image formation region of the photosensitive member is faced to the sleeve 4 after the formation of the blank (FIG. 11). In the foregoing embodiment, the control of the charging is effected using the grid, relay and varistor but the control can be accomplished by directly controlling the high voltage source for the charger.

In addition, the use can e made with a corona charger without the grid, although the foregoing embodiment has been described as having the grid 2*a*.

The charger is not limited to the corona charger provided with a wire electrode and a shield electrode, and may be in the form of a contact type charging device wherein a roller or a blade or the like supplied with a voltage is contacted to the photosensitive member to charge it.

The white reflecting layer is printed in the foregoing embodiment, but it may be provided by attaching a white sheet of paper or a white sheet of resin material to provide a uniform reflecting surface at the boundary with the glass.

In the foregoing description of the embodiments, the original supporting platen is stationary, whereas the scanner moves to scan the original, but the present invention is applicable to the case where the scanner is stationary, whereas the original supporting glass moves.

In the foregoing embodiment, a so-called analog copying apparatus is taken, but the present invention is applicable to a digital image forming apparatus wherein the photosensitive member is exposed to the light from a laser scanner, an LED array, a liquid crystal shutter array or the like as the light application means. In this case, the non-image portion which is a background portion of the image, that is, the background portion of the character or the like is exposed to light (background exposure). Even if there is characters or the like at the leading edge portions of the original, the light from the laser or the like e is always projected to the leading edge portion, by which the lead blank can be formed.

In the foregoing embodiment, the means for projecting light to the region of the photosensitive member which corresponds to the charging means when the charging means is actuated, is the original illuminating lamp 15 which is also for forming an electrostatic latent image on the photosensitive member 1. However, as shown in FIG. 1, an additional light source can be, not the latent image forming light illumination means, may be provided, which may be in the form of an LED array 23, for example, to form the lead blank. Since the region of the photosensitive member which is faced to the charging means when the charging means is actuated, that is, is switched to the chargeable state (the transient region as shown in FIG. 3, the charge potential is relatively low, the amount of the light provided by the LED array 23 may be small. The LED array 23 is controlled by the controller described hereinbefore.

As described in the foregoing, according to the present invention, that region (or at least a leading part of the region when the potential rises quickly) of the photosensitive member which is opposed to the charging means when the charging means is actuated, that is, when it is switched from its non-chargeable state to its chargeable state, that is, the region corresponding to the leading edge of the latent image is exposed to light, whereby a blank can be formed at the leading edge portion of the original in the stabilized manner. Since the blank portion of the leading edge of the original is formed by the light application and by the switching between the non-chargeable state and the chargeable state of the charging means, and therefore, the boundary between the image formation area and the leading blank can be made sharp, so that the quality of the image can be improved.

The formation of the lead blank on the transfer material is effective to provide good releasability of the transfer material from the image fixing means, so that the jam of the transfer material can be prevented.

These and other objects, features and advantages of the present invention will become more apparent upon a consideration of the following description of the preferred embodiments of the present invention taken in conjunction with the accompanying drawings.

What is claimed is:

1. An electrophotographic apparatus, comprising:

a movable photosensitive member;

charging means for uniformly charging a surface of said photosensitive member, said charging means having a predetermined charging region, said charging means being selectively switchable between an operative state and a non-operative state;

means for exposing the surface of said photosensitive member;

transfer means for transferring an image formed on said photosensitive member onto a transfer material; and control mans for controlling said charging means and said exposing means for disabling said charging means for a region of said photosensitive member corresponding to an edge of the transfer material, and to expose such a region of said photosensitive member with light to provide a blank at a region of the transfer material adjacent to its edge.

2. An apparatus according to claim 1, wherein the edge of the transfer material is a leading edge thereof.

3. An apparatus according to claim 1, further comprising original supporting means for supporting an original.

4. An apparatus according to claim 3, wherein said exposing means includes a light source for illuminating the original and a light reflector for reflecting light from the light source.

5. An apparatus according to claim 4, wherein said reflector is disposed to a bottom surface of the original supporting means.

6. An electrophotographic apparatus, comprising:

a movable photosensitive member;

charging means for uniformly charging a surface of said photosensitive member, said charging means having a predetermined charging region, said charging means being selectively switchable between an operative state and a non-operative state;

original supporting means for supporting an original;

illumination means for illuminating the original supported on said original supporting means, wherein the light emitted from said illumination means and reflected by the original is projected onto the surface of said photosensitive member charged by said charging means;

transfer means for transferring an image formed on said photosensitive member onto a transfer material, wherein said charging means starts its charging operation at that position on said photosensitive member which is downstream, by a predetermined distance, of a position corresponding to a leading edge of the transfer material; and a light reflector for illuminating, with light from said illuminating means, a region of said photosensitive member in said charging region, upon switching of said charging means from the non-operative state to the operative state.

7. An apparatus according to claim 6, wherein said light reflector is illuminated by said illumination means.

8. An apparatus according to claim 6, wherein said light reflector is provided on said original supporting means.

9. An apparatus according to claim 8, wherein said light reflector is disposed between said original supporting means and the original supported on said original supporting means.

10. An apparatus according to claim 8, wherein said light reflector extends beyond a leading edge of the original.

11. An apparatus according to claim 6, wherein relative movement is possible between said original supporting means and said illumination means in a direction substantially perpendicular to a longitudinal direction of the light reflector which is in the form of a strip.

12. An apparatus according to claim 6, wherein said charging means is corona charging means having a control electrode.

13. An apparatus according to claim 12, wherein said charging means is selectively placed in the operative state or in the non-operative state by changing a voltage applied to the control electrode.

14. An apparatus according to claim 6, further comprising developing means for developing a latent image on the surface of said photosensitive member with toner.

15. An apparatus according to claim 14, wherein said developing means deposits the toner to such an area of the latent image as is not exposed to light.

16. An apparatus according to claim 14, wherein that region of said photosensitive member which is in the charging region of said charging means when it is in an operative state, corresponds to a size of the transfer material.

17. An apparatus according to claim 14, wherein said developing means is supplied with a voltage by which the toner is not deposited onto the surface of said photosensitive member, when the region of said photosensitive member which is exposed to the light reflected by said light reflector is opposed to said developing means.

18. An apparatus according to claim 6, further comprising means for fixing on the transfer material the image transferred by said transferring means.

19. An apparatus according to claim 18, wherein said fixing means includes a pair of rollers and heating means for heating one or both of the rollers.

20. An apparatus according to claim 6, wherein that region of said photosensitive member which is in the charging region of said charging means when it is in an operative state, is a latent image formation region of said photosensitive member.

21. An electrophotographic apparatus, comprising:

a movable photosensitive member;

charging means for uniformly charging a surface of said photosensitive member, said charging means having a predetermined charging region, said charging means being selectively switchable between an operative state and a non-operative state;

first exposure means for exposing the surface of said photosensitive member charged by said charging means;

transfer means for transferring an image formed on said photosensitive member onto a transfer material, wherein said charging means starts its charging operation at that position on said photosensitive member which is downstream, by a predetermined distance, of a position corresponding to a leading edge of the transfer material; and second exposure means for illuminating a region of said photosensitive member in said charging region, upon switching of said charging means from the non-operative state to the operative state.

22. An apparatus according to claim 21, wherein said first exposure means functions also as said second exposure means.

23. An apparatus according to claim 21, further comprising developing means for developing a latent image formed by said first exposure means with toner.

24. An apparatus according to claim 23, wherein said developing means deposits toner to such an area of the latent image as is not exposed to light by said 25. An apparatus according to claim 23, wherein said developing means is supplied with a bias voltage by which the toner is not deposited to the photosensitive member, when a region of said photosensitive member exposed by said second exposure means is opposed to said developing means.

26. An apparatus according to claim 21, further comprising means for fixing the image, transferred by said transferring means, on the transfer material.

27. An apparatus according to claim 26 wherein said fixing means includes a pair of rollers and heating means for heating one or both of the rollers.

28. An apparatus according to claim 21, wherein that region of said photosensitive member which is in the charging region of said charging means when it is in the operative state, corresponds to a latent image formation area of said photosensitive member.

29. An apparatus according to claim 21, wherein that region of said photosensitive member which is in the charging region of said charging means when it is in the operative state, corresponds to a size of the transfer material.

* * * * *